United States Patent [19]

Borel

[11] Patent Number: 4,592,395

[45] Date of Patent: Jun. 3, 1986

[54] PAPERMACHINE CLOTHING IN A FABRIC WEAVE HAVING NO AXIS OF SYMMETRY IN THE LENGTH DIRECTION

[75] Inventor: Georg Borel, Reutlingen, Fed. Rep. of Germany

[73] Assignee: Hermann Wangner - GmbH & Co. KG, Fed. Rep. of Germany

[21] Appl. No.: 583,968

[22] Filed: Feb. 27, 1984

[30] Foreign Application Priority Data

Mar. 1, 1983 [DE] Fed. Rep. of Germany ..... 3307144

[51] Int. Cl.[4] ..... D03D 15/00; D21F 1/10

[52] U.S. Cl. ..... 139/383 A; 139/416; 139/425 A; 162/DIG. 1

[58] Field of Search ..... 139/425 A, 383 A, 416; 162/DIG. 1, 348, 358

[56] References Cited

U.S. PATENT DOCUMENTS

| | | | |
|---|---|---|---|
| 1,103,943 | 7/1914 | Coups | 139/425 A |
| 1,733,116 | 10/1929 | Coups | 139/425 A |
| 3,464,461 | 9/1969 | Cumming | 139/425 A |
| 4,231,401 | 11/1980 | Matuska | 139/383 A |
| 4,281,688 | 8/1981 | Kelly et al. | 139/383 A |
| 4,437,496 | 3/1984 | Thompson | 139/383 A |
| 4,453,573 | 6/1984 | Thompson | 139/383 A |

FOREIGN PATENT DOCUMENTS

| | | | |
|---|---|---|---|
| 48-15203 | 5/1973 | Japan | 162/348 |

OTHER PUBLICATIONS

*The Cambridge Wire Cloth Company*, Cambridge, Maryland, pp. 1 and 14.

*Primary Examiner*—James Kee Chi

*Attorney, Agent, or Firm*—John J. Torrente

[57] ABSTRACT

A papermachine clothing comprising a fabric whose weave pattern does not have an axis of symmetry in the length direction, and which has in at least a portion of one fabric half a weave mirror-symmetrical to that in at least a portion of the second fabric half and wherein, along the line of contact of the mirror-symmetrical regions, corrective longitudinal wires are interwoven to prevent excessively long floats of the transverse wires on the running side.

2 Claims, 14 Drawing Figures

PAPERMACHINE CLOTHING IN A FABRIC WEAVE HAVING NO AXIS OF SYMMETRY IN THE LENGTH DIRECTION

BACKGROUND OF THE INVENTION

The invention relates to a papermachine clothing of interwoven longitudinal and transverse threads in which the fabric weave has no axis of symmetry in the length direction and the fabric weave in a first region is mirror-symmetrical to that in a second region.

With the exception of a few types of fabric weaves, nearly all the weaves used in the manufacture of papermachine clothings have an asymmetrical structure, i.e. the binding points of the longitudinal wires with the transverse wires are lined in a diagonal direction. As a consequence of this asymmetrical structure, the fabric is more extensible in the diagonal direction than in a direction normal thereto so that the stress-strain behavior of the fabric is directional.

In all twill weaves, this diagonal structure, the so-called twill rib, is particularly pronounced. In satin weave fabrics, however, the binding points are uniformly distributed over the fabric area and do not contact each other. As a result, in each repeat pattern two, three, or more parallel diagonals are formed in lieu of the single diagonal in a twill weave. The appearance of the satin weave fabric is thus finer, and the marking left in the paper sheet is less striking, while the asymmetrical weave structure remains intact, and its effect is the stronger, the greater the asymmetry of the binding points of successive wires.

Under longitudinal stress, the tension in symmetrical weaves is distributed also symmetrically, i.e. the components of force directed to the right and to the left compensate each other. On the other hand, in asymmetrical weaves one component of force predominates. The fabric is thus subject to warping because the binding points directly adjacent or disposed close together render the deformability of the fabric directional. This effect is most pronounced in twill weaves. For this reason such fabrics are useful as papermachine fabrics in at best up to a 4-harness corkscrew twill, and then only on machines of very low specific power input, e.g. tissue machines. Even in these cases fabrics having a standard twill weave are subject to warping after a short time.

In this respect satin weaves are somewhat more favorable because the asymmetry is less pronounced. Thus, single-layer 5-harness satin-weave fabrics can be employed without any problems, and in double-layer fabrics, which are known to have a high degree of filling corresponding to 100–115% of the warp wires, fabrics made in 7 to 12-harness weave are employed. Yet, on high-speed papermachines operating at speeds of 900 m/minute and more regulation problems also arise with double-layer fabrics made in 7-harness weave because the fabrics migrate laterally in the direction of the diagonal rib.

Production is impaired even more by the lateral distortion of the fabric. Occasionally it happens that a fabric has become useless and must be cut out because in the tensioned region it is distorted too much in a lateral direction. While on the breast roll, at the point where the paper stock passes from the breast box to the fabric, the fabric is still perfectly centered, it may arrive at the other end of the fabric section with a lateral displacement of 7 to 10 cm. Since the paper web being formed migrates laterally together with the fabric, it may become removed from the working width of the dandy roller so that it is impossible to continue working with the fabric.

When the fabric diagonal is changed, e.g. when a right-hand diagonal instead of a left-hand diagonal is woven in the fabric, the fabric is distorted in the opposite direction with all the inherent problems for the papermaker. The construction of the papermaking machine in this case is so unfavorable in the upper fabric run that it is not possible to modify the machine design in order to counteract the fabric distortion. Only in the lower run can the fabric guide rolls be offset unilaterally in order to urge the fabric back to its desired middle position.

Distortion in the diagonal direction of a papermachine fabric with asymmetrical weave has been known. It has already been utilized to avoid grooving (groove-like erosion of the supporting surface) of the suction box covering. By altenately weaving the fabric with left-hand diagonal and right-hand diagonal ribs there is obtained a zig-zag extension of the warp wires to thereby avoid grooving of the suction box covering (German Auslegeschrift 1,710,373).

German Offenlegungsschrift 3,044,762 teaches a papermachine fabric in which in the marginal areas the weave alternates mirror-symmetrically from repeat to repeat. By this measure different long weft floats are attained in the marginal areas in order thereby delay the occurrence of tears in the length direction.

It is an object of the present invention to provide a papermachine clothing made of a fabric having a weave which does not have an axis of symmetry in the length direction but which also is not subject to lateral warping or distortion during use.

SUMMARY OF THE INVENTION

In accordance with the principles of the present invention, the above and other objectives are realized in a papermachine clothing having a fabric weave which is mirror symmetrical at least in portions of the two fabric halves of the papermachine clothing.

Rather than making the entire fabric in a single weave, it is the underlying concept of the present invention that the weave be varied so that the forces which tend to distort the papermachine fabric in opposite directions compensate one another. To this end the left-hand screen half, or at least a portion thereof, is made in a weave which tends to make the fabric run toward the left side, while the right-hand half of the fabric, or at least a portion thereof, is made in a weave which tends to draw the fabric toward the right side. In this way the forces pulling toward the right and those pulling toward the left tend to compensate each other causing the papermachine clothing to run straight forward.

As a further favorable side effect, the papermachine clothing is at the same time somewhat stretched in the width direction by these forces. This counteracts the formation of central longitudinal folds which occasionally develop in the middle of the fabric on account of the flexing of weak guide rollers or under unfavorable driving conditions, and which would make the fabric useless.

Symmetrical weaves are usually plain weaves and four-harness crossed twill weaves. Asymmetrical weaves are all standard twill weaves and satin weaves. In accordance with the present invention, a weave would still be regarded as symmetrical even if the symmetry is established by displacement in the longitudinal direction, like in a four-harness crossed twill weave.

The papermachine clothing of the invention may be employed only in a predetermined running direction, since if used in the opposite running direction the opposite effect would occur, i.e. the fabric would have a tendency to run toward the middle.

At the location of the papermachine clothing where the diagonal direction is changed—generally this is the middle of the fabric—deviation in the length of the weft floats both on the paper supporting side and on the running side may occur. As a result of the longer weft floats the weft wires in these places are subject to high wear and are the first to be worn through. This effect cannot be elminated solely by a change of the diagonal direction with or without additional displacement by a few wires in the length direction. However, only the wire floats protruding from the fabric plane are a problem. These protruding floats on the paper side mark the paper web, but, if the difference in the length of the floats is not too great, they can be levelled by grinding the fabric surface on the paper side. On the other hand, protruding floats of the weft wire on the running side may cause marking of the paper web by hydrodynamic pressure waves which may even tear the web. Moreover, these floats are worn through before long.

As above-mentioned, it is only the floats that protrude from the fabric plane that create the above difficulties while, in contrast thereto, hardly any difficulties are encountered with threads that are disposed more deeply in the fabric than is usual in the respective weave. With the conventional warp wire density of 60 or 70 threads per centimeter, for example, the lack of supporting area resulting from an individual wire float that is somewhat submerged is not discenible at all. Likewise, an individual shortened weft float on the running side is harmless. Therefore, according to the invention, corrective longitudinal threads are so interwoven along the line of contact where the regions of different weave meet that each weft thread on the paper supporting or on the running side has substantially no longer float. Hence, excessively long weft floats along the line of contact of the two diagonals are shortened by one or more corrective warp wires woven in a repeat pattern that is entirely independent of the remaining fabric.

The aforementioned corrective warp wires are provided by additional heald frames. Since only 1 to 3 individual threads are needed, expensive frames need not be used and the threads can be interwoven by individually driven special healds. Furthermore, the corrective warp threads follow a course which is independent of the remaining fabric weave and therefore, can be interwoven with all the weft threads that have excessively long floats on the running side. This avoids the the weft floats from protruding from the fabric plane on the runing side.

The papermachine clothing of the invention preferably has fabric halves that are mirror-symmetrical with respect to each other so that the warp wires in the one screen half are threaded in the customary sequence into the healds of the heald frames. In order to avoid an excessively high number of shafts, the draw-in of the warp beyond the middle of the fabric is effected in reversed order. Thus, for instance, for a four-harness fabric the sequence on the left-hand side is 1, 2, 3, 4, while on the right-hand side beginning from the middle the sequence is 4, 3, 2, 1. In this way the binding points form a V pattern in the fabric with the binding diagonal disrupted in the fabric middle without the need of additional shafts.

The present invention is applicable to single-layer and to double-layer and to two-or multi-layer composite fabrics. In two-layer or multi-layer composite fabrics all or only part of the layers can be fabricated according to the invention. When, for example, a two-layer composite fabric must be woven with a fine upper layer in plain weave and with a coarser lower layer in four-harness twill, only the lower layer needs to be provided with a V diagonal and with corrective wires, because the upper layer is already made in a weave with an axis of symmetry extending in the length direction.

The invention is also applicable to flat weaved papermachine clothing which is seamed later on as well as to circularly woven clothing. In the latter case, the realization of the invention is simplified by the fact that the first fabric half can be woven, for example, in a right-hand diagonal weave, and during the optional insertion of any corrective longitudinal wires (weft wires), the weave can be changed accordingly so that the long floats of the transverse wires (weft wires) are shortened. Thereafter, the second fabric half can be woven in the same pattern in the opposite diagonal direction, in the present case in left-hand diagonal direction.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
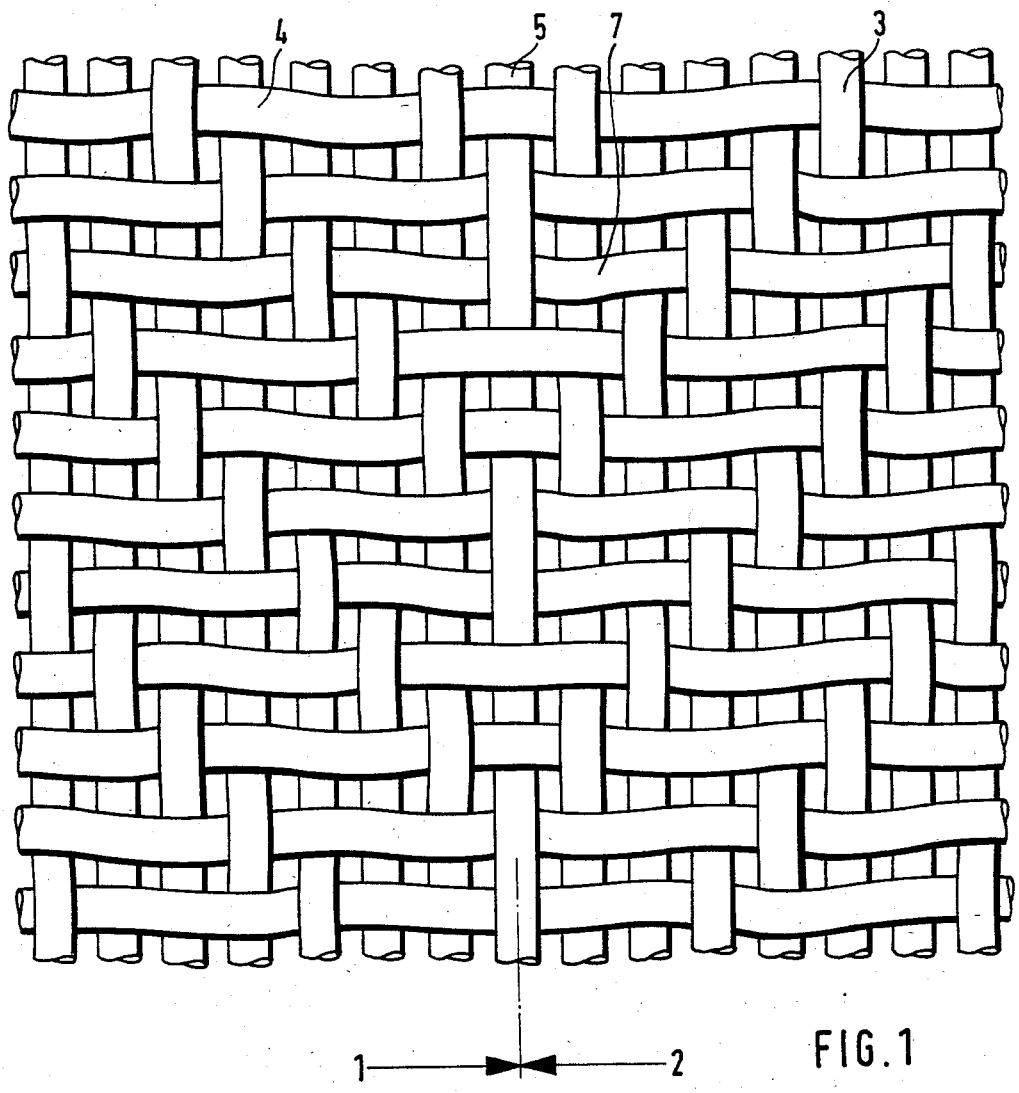
FIG. 1 shows a section of the running side of a papermachine fabric having two regions with mirror-symmetrical weave in accordance with the invention.

FIG. 1 illustrates a section of the running side of a papermachine screen made of a fabric having a harness four-twill weave. The section shows a portion of the left half 1 and of the right half 2 of the papermachine fabric so that the line of contact is discernible. The fabric is composed of warp wires 3 and weft wires 4. A corrective warp wire 5 is included between the left-hand half 1 and the right-hand half 2 of the fabric.

Figure 1A:
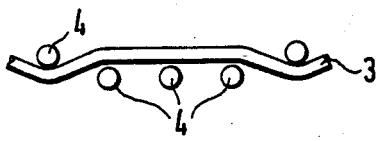
FIGS. 1A, 1B and 2A, 2B show the course of the normal warp wires and the course of the corrective warp wires of the fabrics of FIGS. 1 and 2, respectively.
Figure 1B:
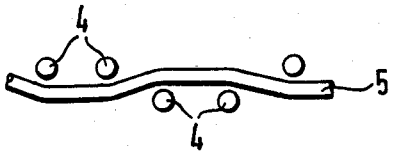

On the running side, the papermachine fabric has weft floats over three warp wires, i.e. it is a so-called weft runner. While the ordinary warp wires 3 have only short floats on the running side corresponding to one weft wire 4, the corrective warp wire 5 has longer floats over two weft wires 4. Without these longer floats the weft wire 7, for example, would have excessively long floats over five warp wires. The corrective warp wire 5 divides the excessively long float into two short floats of two warp wires each. FIG. 1*a* is a section in the length direction showing the course of the ordinary warp wires 3 and that of the corrective warp wires 5 of the fabric of FIG. 1.

Figure 2:
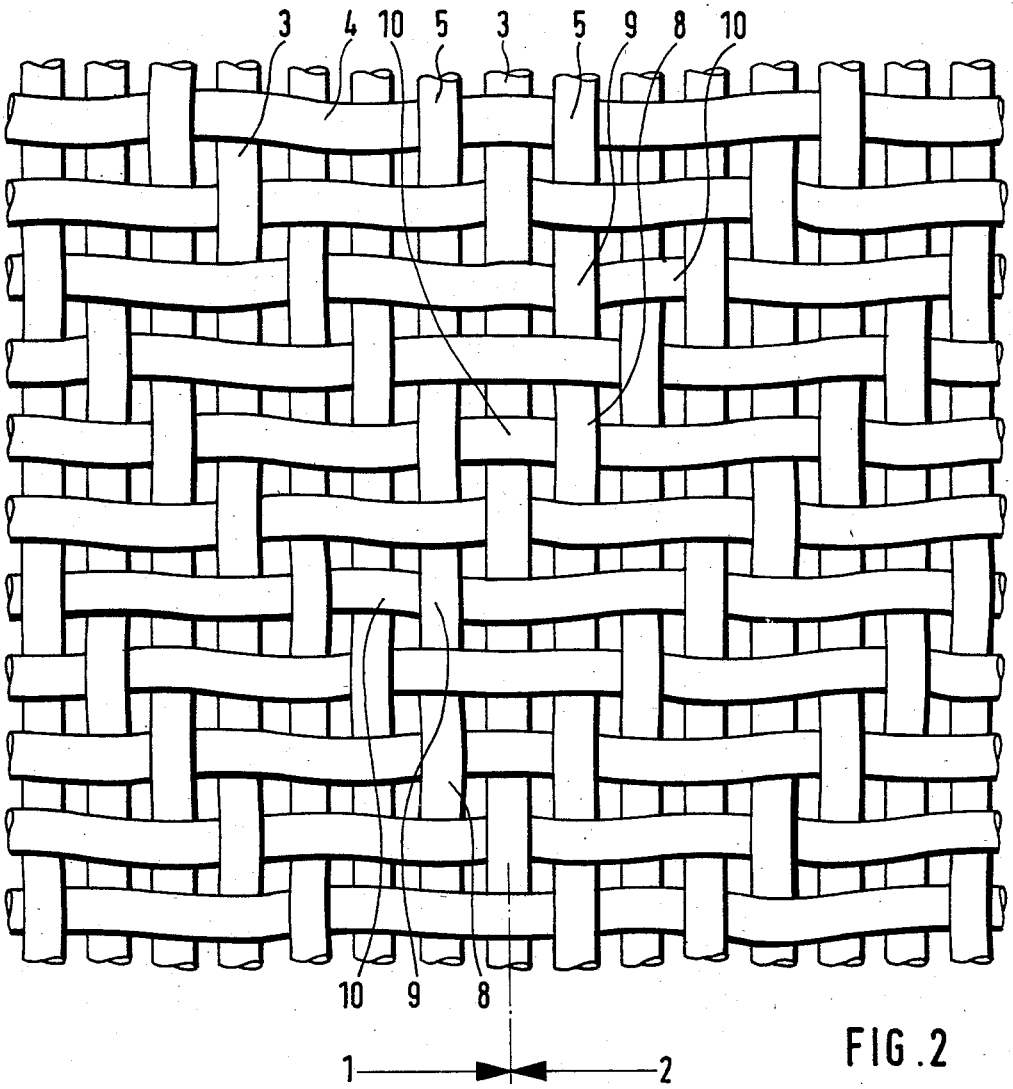
FIG. 2 shows a fabric resembling the fabric of FIG. 1, but having corrective warp wires following a different course.
Figure 2A:
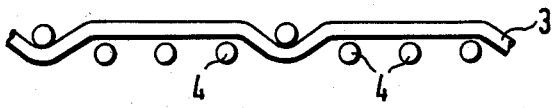
Figure 2B:
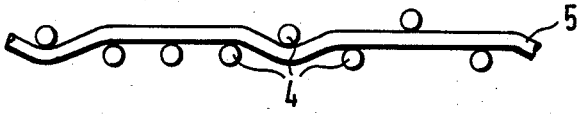
Figure 3:
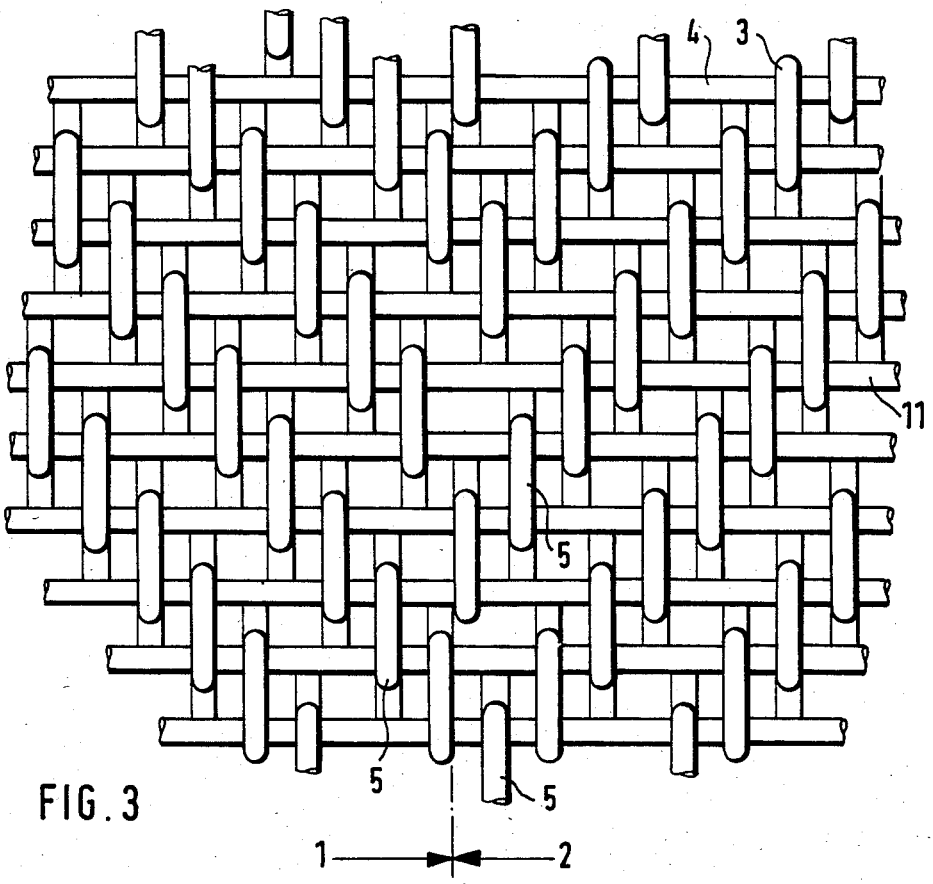
FIGS. 3 and 4 show actual and diagramatic views of the paper side of a 7-harness double-layer fabric in accordance with the invention.
Figure 4:
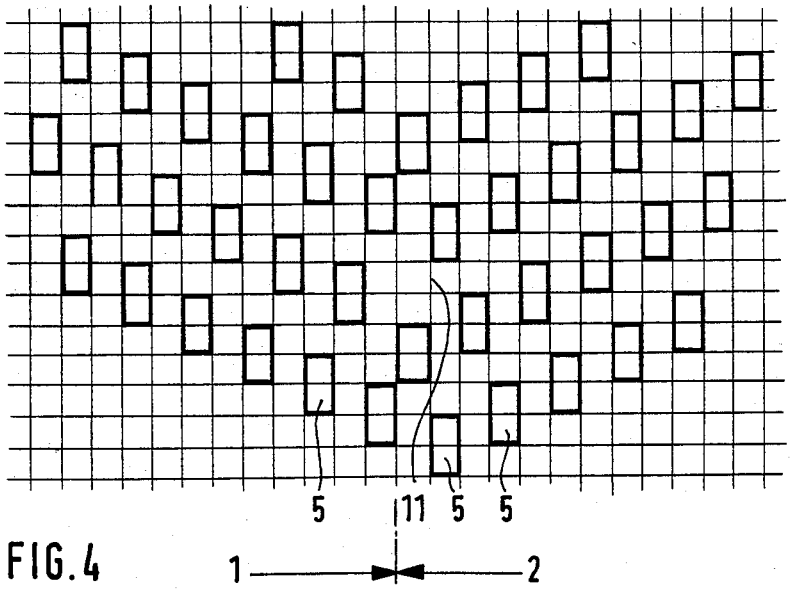

FIG. 2 shows the running side of a papermachine fabric which is similar to the screen of FIG. 1, but which has two corrective wires 5 with an ordinary warp wire 3 disposed therebetween. In addition to the normal binding points 8, the corrective warp wires have further binding points 9 with the weft wire 10 being shortened. FIGS. 3 to 8 relate to a double-layer 7-harness fabric, with FIGS. 3 and 4 showing the paper supporting side of the fabric in actual and in diagrammatic view, respectively. On the paper side, the normal length of the weft float corresponds to 4 warp wires. Only the weft wire 11 has a float that is longer by one warp wire. This minor irregularity is not harmful and can be eliminated by levelling the fabric with slight abrasion. It is thus not necessary to additionally interweave a corrective warp wire to shorten this weft float.

Figure 5:
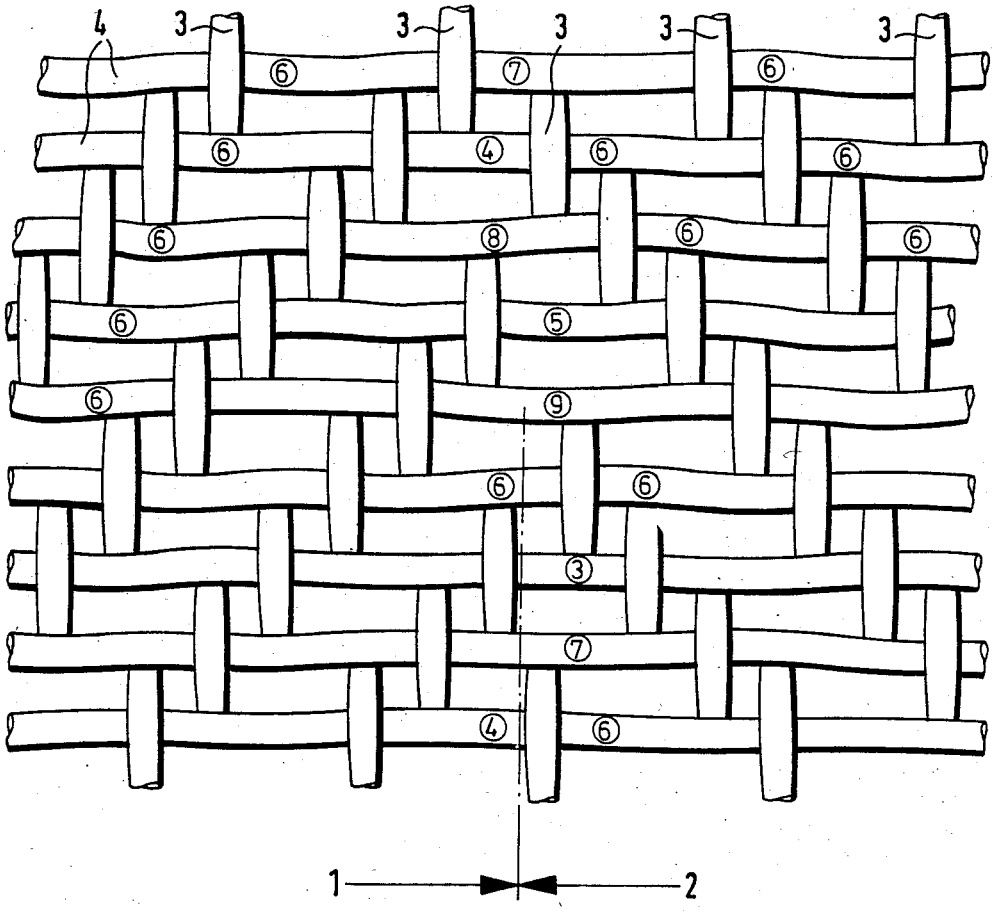
FIGS. 5 and 6 are illustrations of the running side of the fabric of FIGS. 3 and 4 without and with corrective warp wires, respectively.
Figure 7:
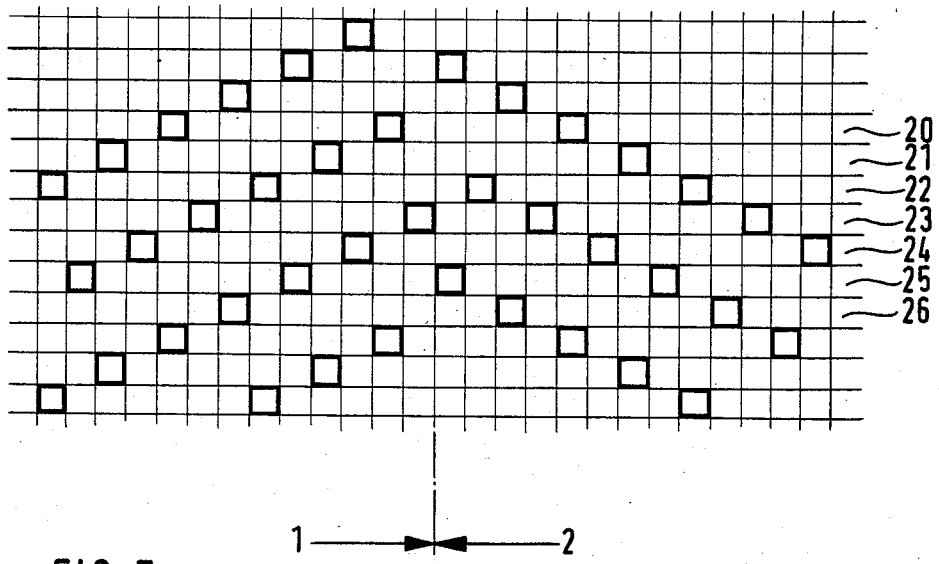

FIGS. 5 and 7 show the running side of the double-layer 7-harness fabric of FIGS. 3 and 4 without corrective warp wires in actual and in diagrammatic view. The encircled numbers in FIG. 5 indicate the length of the weft floats. Hence, in contrast to the normal length of the floats corresponding to six warp wires, floats of a length of up to nine warp wires occur in the absence of corrective wires.

Figure 6:
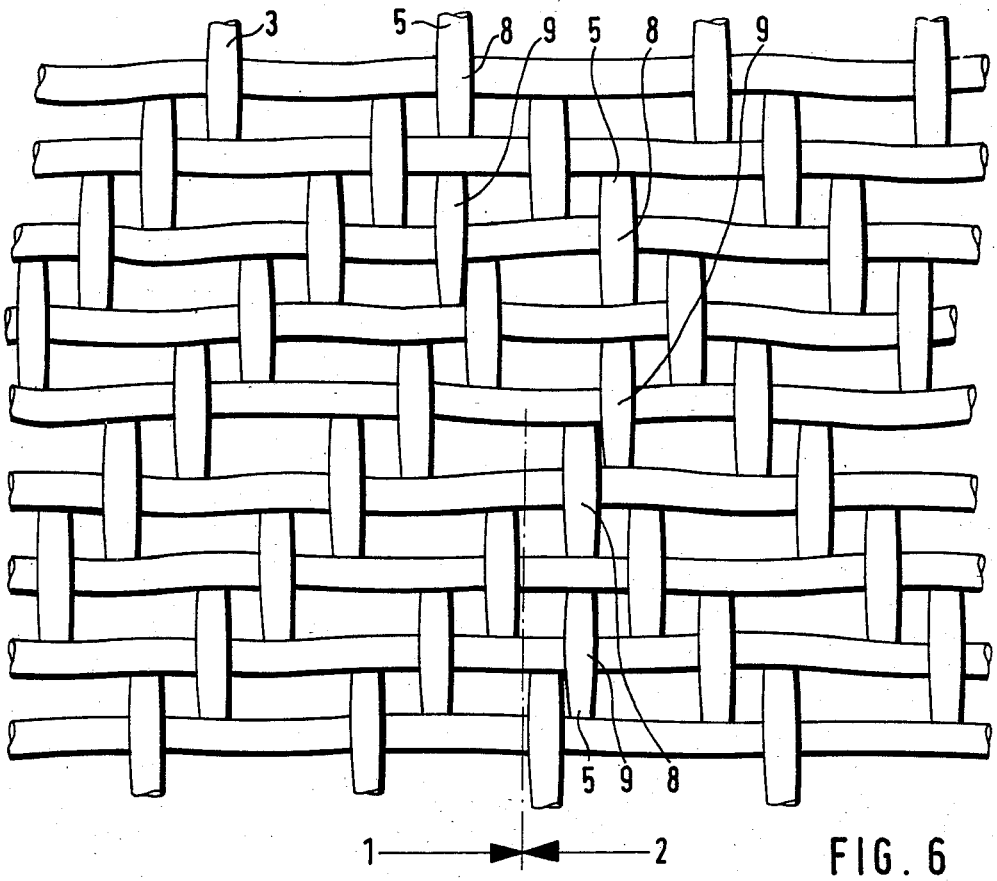
Figure 8:
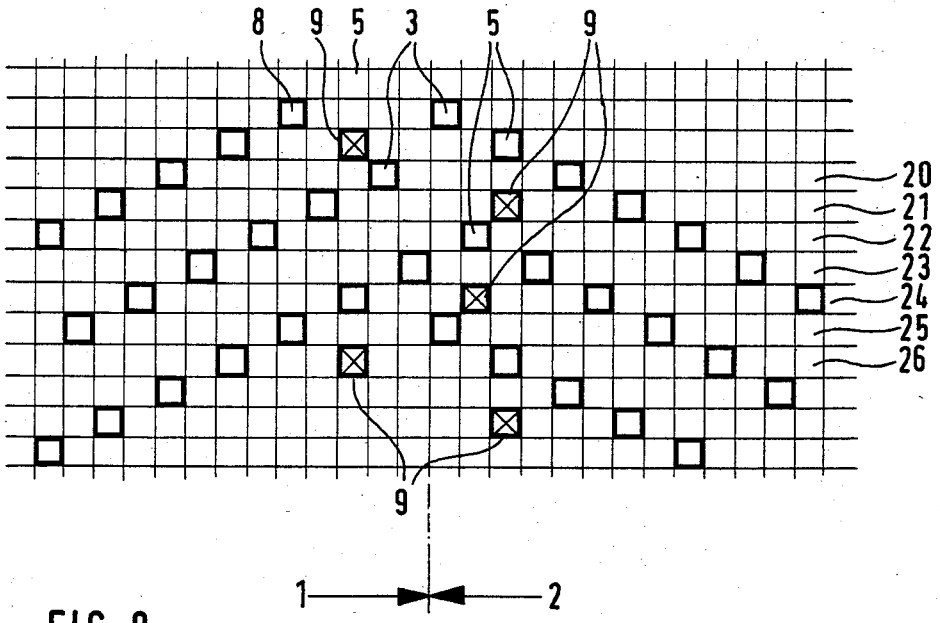

FIGS. 6 and 8 are illustrations similar to those of FIGS. 5 and 7, but with corrective warp wires 5 for shortening the excessively long weft floats. As is best seen by comparing the diagrammatic views of FIGS. 7 and 8, the corrective warp wires 5 are ordinary warp wires 3 with additional binding points which, in FIG. 8, are marked with a cross in the squares of the binding points.

Figure 6A:
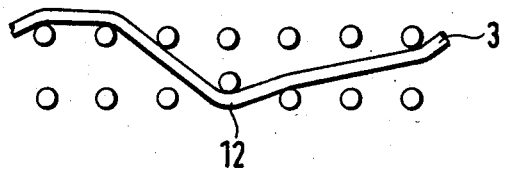
FIGS. 6A, 6B show the course of the ordinary warp wires and of the corrective warp wires of the fabric of FIGS. 3 to 6, and FIGS. 7 and 8 are diagrammatic presentations of the fabric representations of FIGS. 5 and 6, respectively.
Figure 6B:
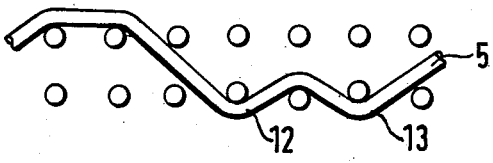

The course of the normal warp wires 3 and of the corrective warp wires 5 is illustrated in FIG. 6*a*. It is evident thereform that the corrective warp wires 5 on the paper supporting side follow the same course as the ordinary warp wires 3, with the only exception being that on the running side they pass around a further weft wire (binding point 13), rather than around only one weft wire (binding point 12).

In all cases, it is understood that the above-described arrangements are merely illustrative of the many possible specific embodiments which represent applications of the present invention. Numerous and varied other arrangements can readily be devised in accordance with the principles of the present invention without departing from the spirit and scope of the invention.

What is claimed is:

1. A papermachine clothing of interwoven longitudinal and transverse threads forming a fabric having a weave pattern which has no axis of symmetry in the length direction wherein the weave pattern of the two fabric halves separated by the longitudinal centerline of the papermachine clothing are mirror-symmetrical with respect to the longitudinal centerline and wherein along the line of contact of the two fabric halves one or more longitudinal threads are interwoven in such a way that on the running side of the fabric there are no floats of transverse threads which are substantially longer than the floats of transverse threads occurring in the fabric weave.

2. A papermachine clothing as claimed in claim 1 wherein the running side is formed predominantly by transverse the threads.

* * * * *